US005289839A

United States Patent [19]

Lombardo

[11] Patent Number: 5,289,839

[45] Date of Patent: Mar. 1, 1994

[54] WIND-RESISTANT UMBRELLA

[76] Inventor: John L. Lombardo, 1426 Nottingham Way, Trenton, N.J. 08609

[21] Appl. No.: 907,590

[22] Filed: Jul. 2, 1992

[51] Int. Cl.[5] ..... A45B 25/22

[52] U.S. Cl. ..... 135/33.7; 135/16

[58] Field of Search ..... 135/33.7, 15.1, 16; 52/199

[56] References Cited

U.S. PATENT DOCUMENTS

| | | | |
|---|---|---|---|
| 3,032,047 | 5/1962 | Wendorf | 135/33.7 |
| 3,456,661 | 7/1969 | Farley | 135/33.7 |
| 3,892,169 | 7/1975 | Jarnot | 135/33.7 |
| 4,223,486 | 9/1980 | Kelly | 52/199 |
| 4,804,008 | 2/1989 | Ryder et al. | 135/33.7 |
| 5,065,779 | 11/1991 | Johnson et al. | 135/33.7 |
| 5,172,711 | 12/1992 | Mueller et al. | 135/16 |

*Primary Examiner*—Carl D. Friedman
*Assistant Examiner*—William E. Wood
*Attorney, Agent, or Firm*—Abdallah & Muckelroy

[57] ABSTRACT

A wind-resistant umbrella to prevent air gusts from turning the fabric body of the umbrella inside out. The umbrella includes a central air vent formed at the upper end of the central rod of the umbrella that vents air downwardly and laterally adjacent to the top of the fabric body. The umbrella further includes a plurality of body air vents in the fabric body of the umbrella.

10 Claims, 3 Drawing Sheets

FIG. 1
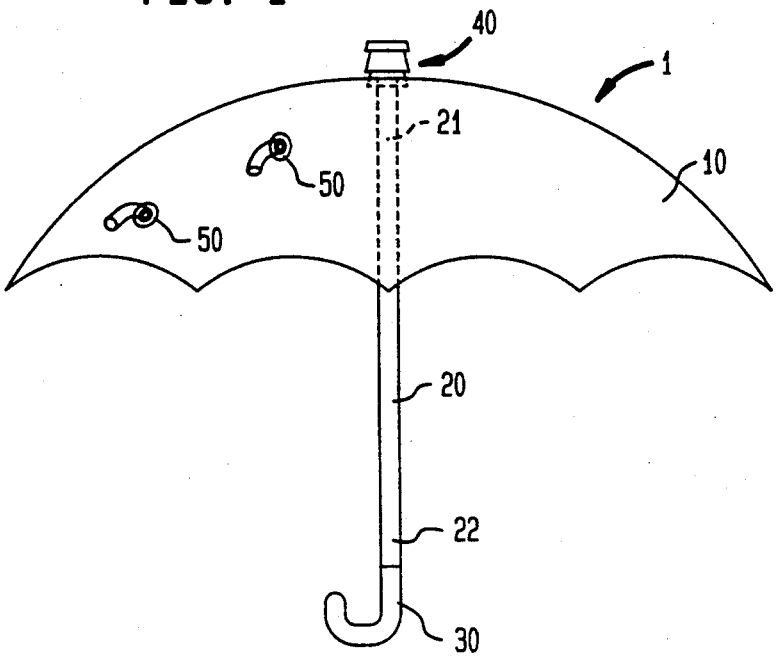
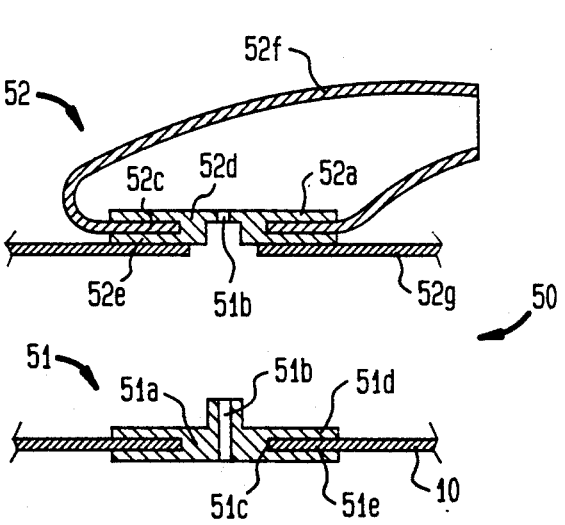
FIG. 2
FIG. 3
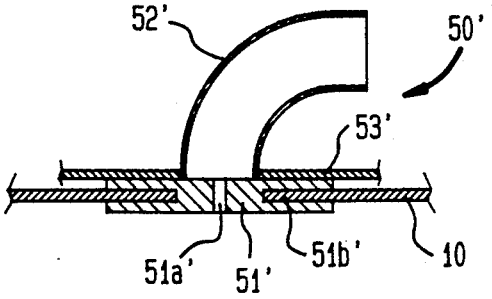

WIND-RESISTANT UMBRELLA

BACKGROUND OF THE INVENTION

The present invention generally relates to umbrellas. More specifically, this invention relates to umbrellas having air venting means which prevent the umbrellas from turning inside out during high winds.

The problems of umbrellas turning inside out from the pressure of high wind is generally known. Various attempts to resolve this problem have been made in the prior art. Umbrellas which have air vents at the crown of the fabric body of the umbrellas are shown in Thomas U.S. Pat. No. 1,031,974; Belnivegna Des. 162,617; Wendorf U.S. Pat. No. 03,032,047; Farley U.S. Pat. No. 3,456,661; and Williams U.S. Pat. No. 4,865,063. In Khalil U.S. Pat. No. 1,723,044 a wind-resistant umbrella is disclosed having air venting means formed in the top portion of the rod handle. Ryder et al U.S. Pat. No. 4,804,008 discloses a wind-resistant umbrella having a plurality of flexible flap vents integrally formed throughout the fabric body of the umbrella.

The prior art wind-resistant umbrellas generally provide means to vent wind pressure by directing air upwardly and laterally from the umbrella. While this construction relieves the pressure on the interior of the umbrella to prevent it from being turned inside out, laterally-blown rain may enter the venting means to render the umbrella ineffective for its primary purpose. A preferred construction for an umbrella having air venting means would prevent even laterally-blown rain from entering the venting means during release of pressure on the umbrella fabric body.

SUMMARY OF THE INVENTION

The present invention is a wind-resistant umbrella having central air venting means formed in the upper end of the central rod which direct wind gusts from the interior of the umbrella downwardly and laterally adjacent to the top surface of the umbrella fabric body. The present wind-resistant umbrella further includes a plurality of body air venting assemblies, respectively comprising a snap-fitting flexible tubing, disposed over openings formed throughout the fabric body of the umbrella.

An object of this invention is to provide an umbrella having air venting means that prevent the umbrella from being turned inside out by wind gusts.

Another object of the present invention is to provide air venting means in an umbrella which prevents laterally-blown rain from entering the venting means.

A further object of the present invention is to provide an umbrella having air venting means which direct air gusts downwardly and outwardly from the umbrella.

These and other objects and advantages of the wind-resistant umbrella of the present invention will be apparent to those skilled in the art from the following description of preferred embodiments, claims and appended drawings.

BRIEF DESCRIPTION OF THE DRAWINGS

FIG. 1 is side elevational view of a first wind-resistant umbrella constructed in accordance with the teachings of the present invention.

FIG. 2 is a fragmented, exploded cross-sectional view of a first body air venting assembly.

FIG. 3 is fragmented, cross-sectional view of a second body air venting assembly.

DESCRIPTION OF PREFERRED EMBODIMENTS

Figure 4:
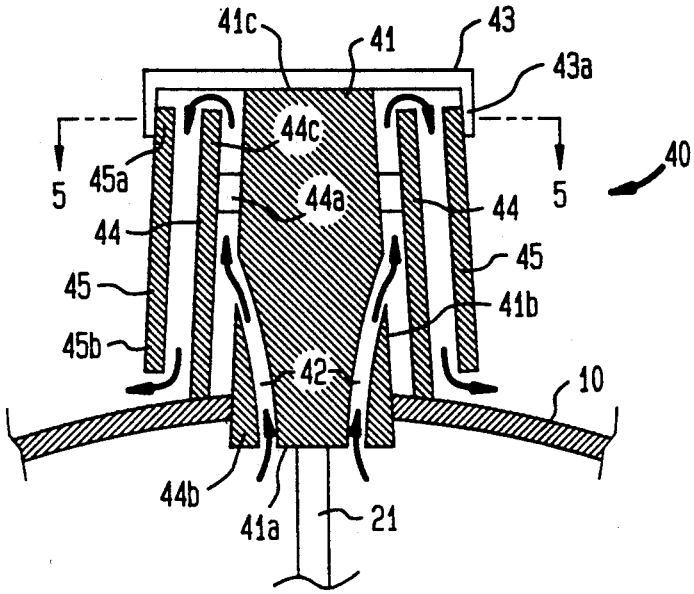
FIG. 4 is a vertical, cross-sectional view of a first central air venting means.

FIG. 1 illustrates in a side elevational view a first wind-resistant umbrella 1 constructed in accordance with the teachings of the present invention. First umbrella 1 includes fabric body 10, selectively collapsible as known in the art, a central rod 20 attached at its upper end 21 to a central portion of the fabric body 10 and a handle 30 fixedly attached to the lower end 22 of central rod 20. First umbrella 1 further includes first central air venting means 40 fixedly attached to the upper end 21 of central rod 20 and a plurality of first body air venting means 50 disposed in displaced relationship throughout fabric body 10. First central air venting means 40 and first body air venting means 50 provide means to prevent the fabric body 10 of first umbrella 1 from turning inside out during high winds.

FIG. 2 illustrates a vertical cross-sectional view of first body air venting means 50. Said first body air venting means 50 generally comprises a snap-fit assembly that includes a first assembly portion 51 fixedly attached to the fabric body 10 and a second assembly portion 52 selectively attachable to said first assembly portion 51. First assembly portion 51 comprises a male button member **51*a* having a male button member aperture 51*b* centrally disposed therein. Male button member 51*a* further includes a first recessed slot 51*c* formed about its periphery which forms respective first peripheral plate extensions 51*d* and 51*e*. Fabric body 10 is received in fixed engagement between plate extensions 51*d* and 51*e***.

Second assembly portion 52 includes a female button member **52*a* having a centrally disposed female button member aperture 52*b*. Female button member aperture 52*b* vertically aligns with the male button member aperture 51*b* when the respective first and second assembly portions 51, 52 are snap-fit together. Female button member 52*a* also includes a second recessed slot 52*c* about its periphery which forms respective second peripheral plate extensions 52*d* and 52*e*. A length of flexible tubing 52*f* having both ends open is attached to the female button member 52*a* of second assembly portion 52. A first end of tubing 52*f* is fixedly disposed in the second recessed slot 52*c* between the respective second plate extensions 52*d*, 52*e*. The remainder of tubing 52*f* is freely disposed about female button member 52*a*. Second assembly portion 52 further includes a first flap cover 52*g* fixedly attached to the lower portion of the female button member 52*a*. First flap cover 52*g* is preferably a circular member (FIG. 1) having a diameter sufficient to cover the peripheral edges of male button member 51*a*. Thereby first flap cover 52*g* helps to seal first assembly portion 51** from water leakage during a rainstorm.

FIG. 3 illustrates a second body air venting means 50' constructed in accordance with the teachings of the present invention. Second body air venting means 50' comprises a flat button member 51' and a flexible tubing 52'. A central aperture 51a' is formed in flat button member 51'. Flat button member 51' further includes a recessed slot 51b' formed about its periphery which receives in fixed engagement the fabric body 10. Flexible tubing 52' is fixedly attached above the central aperture 51a' to communicate with central aperture 51a' and the outer environment of fabric body 10. A second flap cover 53' is fixedly attached to the top portion of flat button member 51' adjacent to second flap cover 53'.

Figure 5:
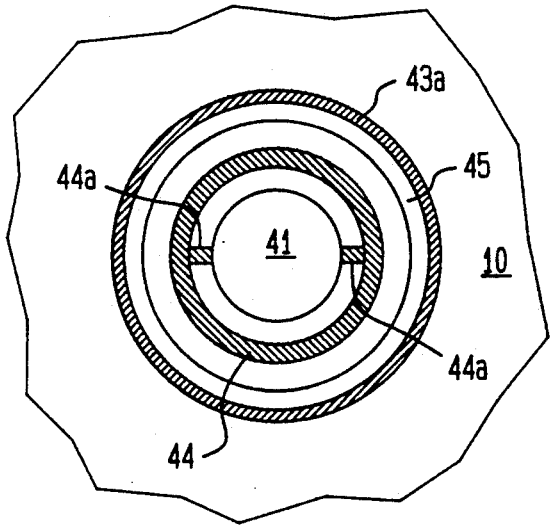
FIG. 5 is a cross-sectional view of the first central air venting means taken along line 5—5 of FIG. 4.

A first embodiment of a central air venting means 40 constructed in accordance with the teachings of the present invention is illustrated in FIGS. 4 and 5. First central air venting means 40 generally includes a central core member 41 having a plurality of substantially vertically oriented channels 42 formed therein which extend from a downward facing opening the bottom wall 41a of said central core member 41 to respective portions of the side wall 41b of said central core member 41. Central core member 41 is fixedly attached at the bottom wall 41a thereof to the upper end 21 of central rod 20. A lower portion of central core member 41 is disposed below the fabric body 10 of umbrella 1 to facilitate direct vertical venting of wind gusts as hereinafter described in greater detail. A central core member cap 43 is fixedly attached to the top wall 41c of central core member 41. Cap 43 extends laterally beyond the side wall 41b of central core member 41 and includes a downwardly-disposed peripheral cap edge 43a. A first air baffle 44 is fixedly attached to the side wall 41b of central core member 41 in displaced relationship therefrom and adjacent to channels 42 by means of first air baffle lateral extensions 44a. The lower end 44b of first air baffle 44 is fixedly attached in sealing engagement with a top portion of fabric body 10. The upper end 44c of first air baffle 44 is disposed in displaced relationship from said central core member cap 43. Thus, air gusts from the channels 42 in central core member cap 43. Thus, air gusts from the channels 42 in central core member 41 are received by the downward facing opening and directed upwardly between the side wall 41b of central core member 41 and first baffle 44.

A second air baffle 45 is fixedly attached at a top portion 45a thereof to the cap edge 43a. Second air baffle 45 is disposed in displaced relationship from first air baffle 44 and the lower end 45b of second air baffle 45 is displaced from the top portion of fabric body 10. Thereby air gust may be directed downwardly between first air baffle 44 and second air baffle 45 and laterally outward from first central air venting means 40 adjacent the top surface of fabric body 10. As can be seen in FIG. 5 first air baffle 44 and second air baffle 45 are preferably formed as concentric rings about central core member 41.

Figure 6:
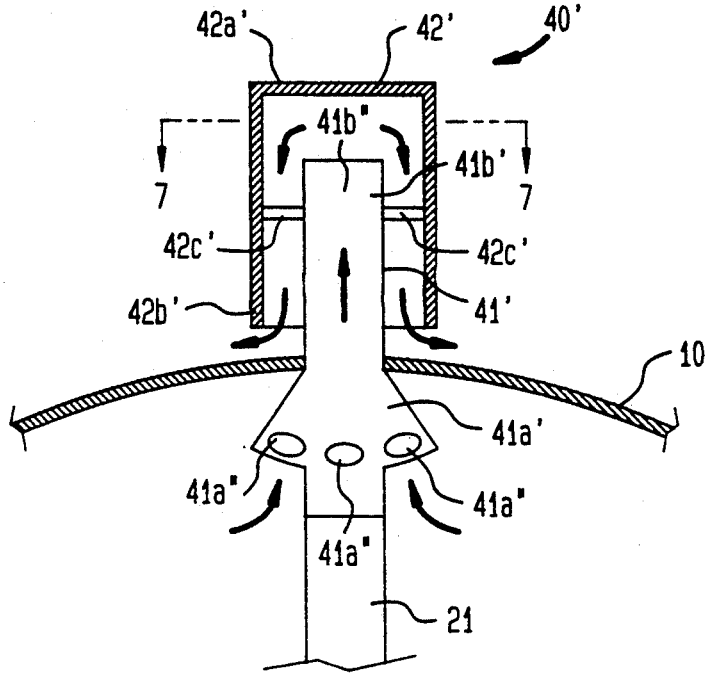
FIG. 6 is a partially cross-sectioned, side elevational view of a second wind-resistant umbrella in accordance with the teachings of the present invention.
Figure 7:
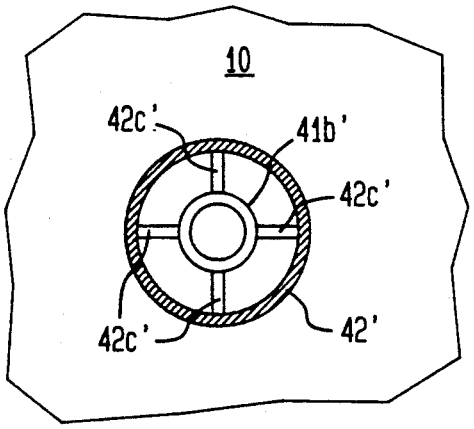
FIG. 7 is a cross-sectional view taken along line 7—7 of FIG. 6.

FIGS. 6 and 7 illustrate a second central air venting means 40' in accordance with the present invention. Second central air venting means 40' includes a hollow rod extension 41' coextensive with the upper end 21 of central rod 20, and a hollow cap housing member 42' disposed in displaced relationship over the top end of rod extension 41'. Rod extension 41' includes an outwardly-flared rod extension body 41a' at a lower end thereof disposed below fabric body 10 and a rod extension neck 41b' extending upwardly from rod extension body 41a' above fabric body 10. Rod extension body 41a' has a plurality of downwardly facing openings 41a'' which communicate with the interior portion of rod extension neck 41b'. The upper end 41b'' of rod extension neck 41b' is open and therefore wind gusts may be directed through the downwardly facing openings 41a'' to the interior of neck 41b' and outwardly therefrom through the open upper end 41b'' of rod extension neck 41b'.

Cap housing member 42' substantially comprises an inverted cup having its closed top end 42a' disposed in displaced relationship from the upper end 41b'' of rod extension neck 41b'. The open bottom end 42b' of cap housing member 42' is disposed in displaced relationship from the top surface of fabric body 10. The side wall 42c' of cap housing member 42' is circumferentially disposed in displaced relationship about rod extension neck 41b' and thereby permits the flow of wind gusts from the upper end 41b'' of rod extension neck 41b' downwardly between the rod extension neck 41b' and cap housing member 42' and laterally outward therefrom adjacent to the top surface of fabric body 10. As best seen in FIG. 7 cap housing member 42' is retained in the desired position relative to rod extension neck 41b' by cap housing member extensions 42c' fixedly attached to rod extension neck 41b'.

The wind-resistant umbrella 1 of the present invention provides air venting means in the fabric body 10 and at the top of the central rod 20. Wind gusts that normally turn the fabric body 10 inside out are vented. The respective central air venting means 40 and 40' of the present invention vent the air gust downwardly and laterally outwardly adjacent to the top surface of fabric body 10. This facilitates the prevention of fabric body 10 from turning inside out by creating downward pressure on the top surface of fabric body 10 in addition to the air venting accomplished thereby.

Various changes, additions and modifications may be made to the preferred embodiments of the present disclosure without departing from the spirit and scope of this invention. Such changes, additions and modifications within a fair reading of the following claims are intended as part of the present disclosure.

Therefore, in view of the foregoing I claim:

1. A wind-resistant umbrella comprising a selectively collapsible fabric body;

a central rod attached to a central portion of said fabric body;

a handle attached to a lower end of said central rod; and central air venting means comprising a rigid cup member attached to an upper end of said central rod, said air venting means including substantially vertically oriented air channeling means to upwardly vertically direct wind gusts from an interior of the fabric body downwardly and laterally adjacent an exterior of the fabric body.

2. A wind-resistant umbrella as in claim 1 further including at least one constantly open flexible body air venting means venting air outwardly from said interior, said venting means disposed in the fabric body of said umbrella.

3. A wind-resistant umbrella as in claim 2 wherein body air venting means comprises a snap-fit assembly including (a) a first assembly portion fixedly attached to the fabric body and including a first central aperture, and (b) a second assembly portion selectively attachable to said first assembly portion and including a flap cover disposable adjacent to the first assembly portion and a length of flexible tubing fixedly attached to and extending outwardly from said second assembly portion, said second assembly portion having a second central aperture formed therein which aligns with said first central aperture when said second assembly portion is attached to said first assembly portion.

4. A wind-resistant umbrella as in claim 2 wherein said respective body air venting means comprises a button member fixedly attached to the fabric body and including a central aperture, and a length of flexible tubing fixedly attached to and extending outwardly from said button member;

5. A wind-resistant umbrella as in claim 4 further including a flap cover fixedly attached to a top portion of said button member.

6. A wind-resistant umbrella as in claim 1 wherein said central air venting means comprises a central core member fixedly attached to an upper end of the central rod, said central core member having at least one central core substantially vertically oriented channel extending from a lower portion of said central core member to a side portion of said central core member;

a central core member cap fixedly attached to an upper end of the central core member, said cap extending laterally beyond an outer periphery of said central core member;

a first air baffle fixedly attached to the side portion of said central core member adjacent to the central core channel and disposed in displaced relationship from said central core member, said first air baffle being fixedly attached along a lower end thereof to a top portion of the fabric body and an upper end of the first air baffle being disposed in displaced relationship from said central core member cap thereby providing a first channel extension of said central core channel whereby air gusts are directed from said central core channel upwardly between said central core member and said first air baffle; and a second air baffle having an upper portion thereof fixedly attached to said central core member cap and a lower end thereof disposed in displaced relationship from the top portion of said fabric body, said second air baffle being disposed in displaced relationship from said first air baffle thereby providing a second channel extension of said first channel extension whereby air gusts are directed from said first channel extension downwardly between said first air baffle and said second air baffle and thereafter outwardly laterally adjacent to the top portion of said fabric body.

7. A wind-resistant umbrella as in claim 1 wherein said central air venting means comprises a hollow rod extension co-extensive with an upper end of the central rod, said rod extension having at least one downwardly facing aperture formed at a lower end thereof, the top end of said rod extension being open; and a hollow cap housing member fixedly attached to and disposed over the rod extension in displaced relationship, a lower end of said cap housing member being disposed in displaced relationship from a top portion of the fabric body.

8. A wind-resistant umbrella as in claim 7 wherein a lower portion of said rod extension includes an outwardly flared rod extension body, said at lest one aperture being disposed in said flared rod extension body.

9. A wind-resistant umbrella comprising a selectively collapsible fabric body;

a central rod attached to a central portion of said fabric body; a handle attached to a lower end of said central rod; central air venting means attached to an upper end of said central rod, said central air venting means comprising a substantially vertically oriented opening; a central core member fixedly attached to an upper end of the central rod, said central core member having at least one central core channel extending from a lower portion of said central core member to a side portion of said central core member;

a central core member cap fixedly attached to an upper end of the central core member, said cap extending laterally beyond an outer periphery of said central core member;

a first air baffle fixedly attached to the side portion of said central core member adjacent to the central core channel and disposed in displaced relationship from said central core member, said first air baffle being fixedly attached along a lower end thereof to a top portion of the fabric body and an upper end of the first air baffle being disposed in displaced relationship from said central core member cap; and a second air baffle having an upper portion thereof fixedly attached to said central core member cap and a lower end thereof disposed in displaced relationship from the top portion of said fabric body, said second air baffle being disposed in displaced relationship from said first air baffle; and at least one constantly open body air venting means disposed in said fabric body, said body air venting means venting air outward from said interior comprising a snap-fit assembly-including (a) a first assembly portion fixedly attached to the fabric body and including a first central aperture; and (b) a second assembly portion selectively attachable to said first assembly portion in snap-fitting engagement, said second assembly portion including a flap cover disposable adjacent to the first assembly portion and a lengthy of flexible tubing fixedly attached to and extending outwardly from said second assembly portion, said second assembly portion having a second central aperture formed therein selectively alignable with the first central aperture.

10. A wind-resistant umbrella comprising a selectively collapsible fabric body;

a central rod attached to a central portion of said fabric body;

a handle attached to a lower end of said central rod; central air venting means attached to an upper end of said central rod, said central air venting means comprising a hollow rod extension co-extensive with an upper end of the central rod, said rod extension having an outwardly flared rod body formed at a lower portion of said rod extension, at least one downwardly facing aperture being formed at a lower end of said body, the top end of said rod being open, and a hollow housing member fixedly attached to and disposed over the top end of the rod extension in displaced relationship, a lower end of said housing member being disposed in displaced relationship from a top portion of the fabric body; and at least one constantly open body air venting means disposed in said fabric body.

* * * * *